US005326019A

United States Patent [19]

Wolff

[11] Patent Number: 5,326,019

[45] Date of Patent: Jul. 5, 1994

[54] DOUBLE WALLED PAPER CUP

[76] Inventor: Steven K. Wolff, 1418 SW. 351st St., Federal Way, Wash. 98023

[21] Appl. No.: 55,255

[22] Filed: May 3, 1993

[51] Int. Cl.[5] ..... B65D 3/22

[52] U.S. Cl. ..... 229/1.5 B; 220/445

[58] Field of Search ..... 229/1.5 B, 1.5 H; 220/416, 418, 441, 443, 445, 448, 732, 737, 739, 903; 206/594

[56] References Cited

U.S. PATENT DOCUMENTS

| | | | |
|---|---|---|---|
| 2,266,828 | 12/1941 | Sykes | 229/1.5 B |
| 2,591,578 | 4/1952 | McNealy et al. | 229/1.5 B |
| 2,661,889 | 12/1953 | Phinney | 229/1.5 B |
| 2,853,222 | 9/1958 | Gallagher | 229/1.5 B |
| 3,082,900 | 3/1963 | Goodman | 220/445 |
| 3,141,913 | 7/1964 | Edwards | 209/1.5 B |
| 3,456,860 | 7/1969 | Janninck | 220/445 |
| 3,908,523 | 9/1975 | Shikaya | 229/1.5 B |
| 4,261,501 | 4/1981 | Watkins et al. | 229/1.5 B |
| 4,993,580 | 2/1991 | Smith | 206/594 |
| 5,092,485 | 3/1992 | Lee | 229/1.5 B |
| 5,205,473 | 4/1993 | Coffin, Sr. | 229/1.5 H |

FOREIGN PATENT DOCUMENTS

| | | | |
|---|---|---|---|
| 1912705 | 10/1969 | Fed. Rep. of Germany | 229/1.5 B |
| 4-6036 | 1/1992 | Japan | 229/1.5 B |
| 291640 | 7/1965 | Netherlands | 229/1.5 B |
| 1366310 | 9/1974 | United Kingdom | 229/1.5 B |

*Primary Examiner*—Gary E. Elkins
*Attorney, Agent, or Firm*—John P. Halvonik

[57] ABSTRACT

The invention is a paper cup of double walled construction with an air pocket between the walls. The cup may find use in keeping warm beverages warm and/or cold beverages cold for reasonable periods of time. In the preferred embodiment, a spiral band of paper is in connection with both the inner wall and the outer wall. This member keeps the walls apart to create the air pocket and provides structural rigidity. The cup may be made of relatively narrow width with a small air space between the inner and outer walls.

5 Claims, 1 Drawing Sheet

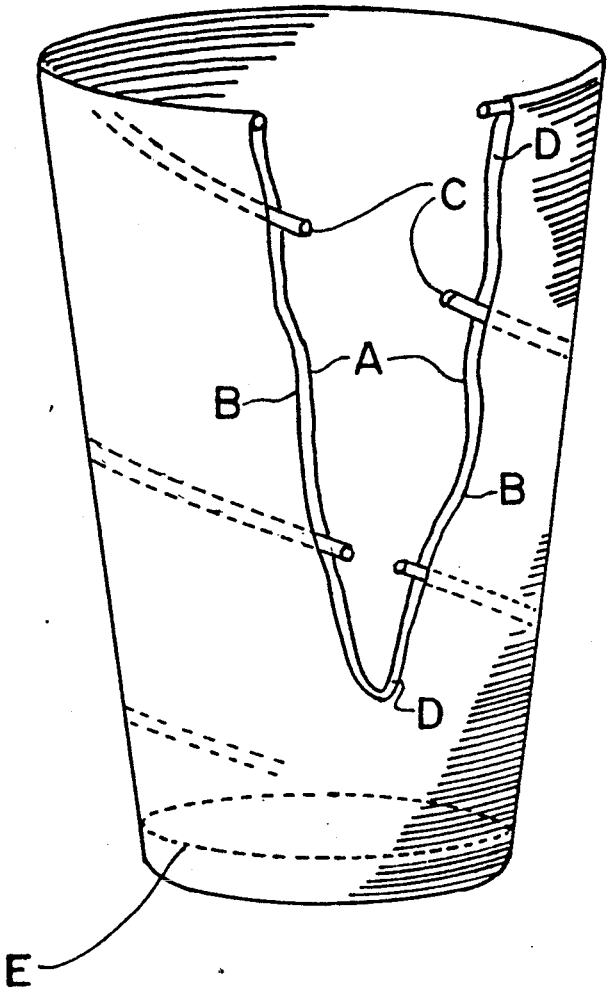
D
C
A
B
B
D
E

DOUBLE WALLED PAPER CUP

BACKGROUND AND PRIOR ART

The invention relates to the field of beverage containers and in particular to paper cups. There are no double-walled beverage receptacles made of paper that the applicant is aware of. It is believed that the use of a double wall is novel in the context of paper cups. It is also believed that using double walled paper cups offers advantages over other evacuated containers that have not been seen in the prior art.

It is believed that the invention will find utility among the large companies that supply hot beverage's such as coffee. Fast food franchisees in particular, usually provide a great deal of coffee and need a supply of cheap receptacles for such beverages. Usually, such companies simply supply the coffee in paper cups without giving thought to the need to keep such beverages warm for a period of time. Other companies provide receptacles for beverages made of styrofoam. Styrofoam may be used as an insulator for beverages however, it is not environmentally safe. That is, styrofoam is not biodegradable and will pollute the environment if a styrofoam cup is simply thrown away.

SUMMARY OF THE INVENTION

The invention is a paper cup having inner and outer walls made of paper. The inner and outer walls are spaced apart from one another by means of a spacer or insert located between the two layers. This spacer may be merely a paper member having a thickness of about ⅛-½" and wound in spiral fashion between the inner and outer wall. Between the layers a pocket of air is created and this acts as an insulator for cold and warm beverages. The spiral member also provides structural rigidity. The bottom of the cup may be one layer. The cups may be made with a relatively narrow width, the air space between the inner and outer walls being about ⅛-½".

It is an object of the invention to provide a paper cup that is environmentally safe and is able keep warm beverages warm for a reasonable time period.

Another objective is to provide an insulated beverage cup that is environmentally safe, and is degradable.

Another objective of the invention is to provide an insulated beverage cup that will prevent the user's hands and fingers from being burnt by the heat from the beverage.

Still another objective is to provide an insulated beverage container that is inexpensive to produce and will keep cold beverages cold for a reasonable time.

Other objective will become known to those skilled in the art once the invention is shown and described.

DESCRIPTION OF THE DRAWINGS

FIG. 1 Shows the overall construction of the invention.

DESCRIPTION OF THE PREFERRED EMBODIMENT

The invention is shown with a removed section in FIG. 1. Each cup is comprised of an inner wall A and an outer wall B. The cup may be constructed in various ways including making blanks of the inner and outer wall and then connecting them together to form a cylindrical shape. Usually a third member E is added to walls after they are rolled up. This member functions as the bottom of the cup. It is thought that the walls should be spaced about ⅛-½" apart and thus the inner wall should be made accordingly a little shorter than the outer wall.

The space D between the walls will create an air barrier that offers some insulation for both warm and cold beverages. Air is a relatively effective barrier to heat and the space required to insulate warm beverages is not great, probably an air space of as little as ⅛" would be enough to insulate the hot coffee or other beverage in order to keep it from burning the hands of the user.

This size air space is also sufficient to keep the beverage cold or warm for a reasonable amount of time considering the relatively inexpensive nature of the cup. In other words, one could construct a cup with a larger air space with added expense going into making such a cup structurally sound. By the same token, the air space could be made smaller but with less effectiveness as insulation.

It is preferred that the insert C be placed between the walls in a spiral fashion seen in FIG. 1. The insert would generally run in a spiral fashion along the outer surface of the inner wall and also along the inner surface of the outer wall. In other words, it is in connection with both walls and serves to keep them a short distance apart. The general direction of the spiral pattern that the insert undertakes is shown in FIG. 1.

Of course other configurations of the insert are possible without violating the spirit of the invention. For instance, the insert could be laid out as horizontal ribs running across the walls or the insert could be randomly spaced bumps in the walls. The spacer may be of square or rectangular cross section in order to align flush with each wall. Other shapes such as round, etc. could be also be used for the spacer.

In addition to creating the air space, the spacer also provides structural rigidity to the cup itself. It is preferred that this member may be made of paper e.g. the walls themselves.

The bottom of the cup may also be made of paper. It is not believed necessary that this member be a double wall e.g. the side walls, a single wall or layer should be sufficient. It is also preferred that the bottom wall be somewhat above the level of the very bottom edges of the walls. This so that the bottom wall does not burn the fingers as it has only one wall. In other words, it is preferred that the bottom wall not be flush with the surface the cup is resting upon.

I claim:

1. A beverage receptacle comprising: an inner wall of cylindrical construction and having a fixed radius and having an outer surface and an inner surface, a spacer in connection with said outer surface, said spacer disposed upon said outer surface in a spiral configuration with radius corresponding to that of said inner wall, an outer wall of cylindrical construction and of larger diameter than said inner wall, said outerwall in connection with said spacer so as to form an air space between said inner and outer walls.

2. The apparatus of claim 1 wherein said outer and inner walls are made of paper.

3. The apparatus of claim 2 having a bottom member in connection with said inner wall.

4. The apparatus of claim 3 wherein said spacer is made of paper.

5. The apparatus of claim 4 wherein said spacer is about ⅛-½" in thickness.

* * * * *